US008517296B2

(12) United States Patent
Frerich et al.

(10) Patent No.: US 8,517,296 B2
(45) Date of Patent: Aug. 27, 2013

(54) GRINDING MILL WITH DUAL ARTICULATION ACTUATION CYLINDER

(75) Inventors: Daniel Frerich, Lippstadt (DE); Nils Hörster, Ennigerloh (DE); Alexander Peters, Beckum (DE); Ludwig Könning, Ahlen (DE); Thomas Rüther, Drensteinfurt (DE)

(73) Assignee: Polysius AG, Beckum (DE)

( * ) Notice: Subject to any disclaimer, the term of this patent is extended or adjusted under 35 U.S.C. 154(b) by 232 days.

(21) Appl. No.: 13/087,501

(22) Filed: Apr. 15, 2011

(65) Prior Publication Data

US 2011/0253825 A1 Oct. 20, 2011

(30) Foreign Application Priority Data

Apr. 16, 2010 (DE) ..... 10 2010 016 472

(51) Int. Cl.
*B02C 4/32* (2006.01)

(52) U.S. Cl.
USPC ..... 241/230

(58) Field of Classification Search
USPC ..... 241/230–233, 285.3
See application file for complete search history.

(56) References Cited

U.S. PATENT DOCUMENTS

| | | | | |
|---|---|---|---|---|
| 3,846,883 | A * | 11/1974 | Biondetti | 492/7 |
| 5,261,324 | A * | 11/1993 | Jakobs et al. | 100/158 R |
| 6,387,219 | B2 * | 5/2002 | Snellman | 162/358.3 |
| 6,409,884 | B2 * | 6/2002 | Brox | 162/358.3 |
| 7,387,710 | B2 * | 6/2008 | Bengtsson | 162/358.3 |

FOREIGN PATENT DOCUMENTS

| | | | |
|---|---|---|---|
| CA | 2059348 | A1 * | 8/1992 |
| DE | 4034822 | A1 | 4/1992 |
| DE | 4103887 | A1 | 8/1992 |

* cited by examiner

*Primary Examiner* — Dana Ross
*Assistant Examiner* — Leonel Vasquez
(74) *Attorney, Agent, or Firm* — Renner Kenner Greive Bobak Taylor & Weber

(57) ABSTRACT

The roller grinding mill for comminuting brittle grinding stock includes at least one grinding roller which co-operates with a counter-face in such a manner that the grinding stock is comminuted between the grinding roller and the counter-face and a pressing system for applying a force to the grinding stock via the grinding roller. The pressing system includes: at least one hydropneumatic store and at least one dual-articulation actuating cylinder. The dual-articulation actuating cylinder is connected to the hydropneumatic store and has two pistons and a housing which acts as a coupling rod.

9 Claims, 3 Drawing Sheets

GRINDING MILL WITH DUAL ARTICULATION ACTUATION CYLINDER

TECHNICAL FIELD

The invention relates to a roller grinding mill for comminuting brittle grinding stock having at least one grinding roller which co-operates with a counter-face in such a manner that the grinding stock is comminuted between the grinding roller and the counter-face, and a pressing system for applying a force to the grinding stock via the grinding roller.

BACKGROUND OF THE INVENTION

Such a roller grinding mill is, for example, a roller mill having two grinding rollers which are pressed against each other and which are supported by means of cylinder roller bearings, tapered roller bearings or plain bearings in a bearing housing. One of the two rollers is supported as a fixed roller and the other as a loose roller. During operation of this roller mill, there may be relatively significant occurrences of incorrect positioning of the movable loose roller. This incorrect positioning, in the case of the types of bearing mentioned above, leads to distortion of the bearing housing in the machine frame.

In order to absorb this incorrect positioning of the loose roller with respect to the machine frame in terms of force, DE 40 34 822 A1 proposes a single-articulation hydraulic cylinder with a pressure piece and resilient cushion composed of rubber. This combination of components acts as a coupling rod with two pivot joints between two counter-bearings.

In DE 41 03 887 A1 there is proposed for this application a dual-articulation hydraulic cylinder which compensates for the disadvantages of the short coupling length and the rubber cushion which is difficult to rotate. The coupling length is intended to be understood to be the distance between the pivot joints.

SUMMARY OF THE INVENTION

An object of the present invention is to further increase the coupling length with a predetermined structural space and stroke.

This object is achieved according to the invention by the features of claim 1.

The roller grinding mill according to the invention for comminuting brittle grinding stock substantially comprises a. at least one grinding roller which co-operates with a counter-face in such a manner that the grinding stock is comminuted between the grinding roller and the counter-face and b. a pressing system for applying a force to the grinding stock via the grinding roller, the pressing system having the following components:

b1. at least one hydropneumatic store and b2. at least one dual-articulation actuating cylinder which is connected to the hydropneumatic store and which has two pistons and a housing which acts as a coupling rod.

The coupling length can be maximised by the housing which acts as a coupling rod and by using two pistons.

The dependent claims relate to other embodiments of the invention.

According to a preferred embodiment of the invention, the dual-articulation actuating cylinder has two pivot joints which have fixed spacing relative to each other and which are preferably constructed on journals connected to the housing. Those two journals may particularly be constructed in the manner of universal ball joints. There may further be provision for the two pistons to be supported in such a manner that the force which can be produced by the actuating cylinder can be transmitted to the at least one grinding roller with lateral and angular displacement.

The actuating cylinder preferably has two articulations which are in the form of articulated bearings. There may further be provision for both pistons to be rotationally movable and for at least one of the two pistons to be displaceable in a linear manner. This can be achieved, for example, in that the actuating cylinder provides for each piston a pivot joint which has a first contact face on the housing and a second contact face on the piston or an intermediate element arranged between the piston and the housing. If an intermediate element is provided between the first contact face and at least one of the pistons, the intermediate element may have the second contact face at one side and, at an opposite face, a third contact face which allows linear displacement between the piston and the intermediate element.

According to another embodiment of the invention, the actuating cylinder is provided with pressure oil lubrication.

BRIEF DESCRIPTION OF THE DRAWINGS

Other advantages and embodiments of the invention will be explained in greater detail below with reference to the description and the drawings, in which.

DETAILED DESCRIPTION OF THE INVENTION

Figure 1:
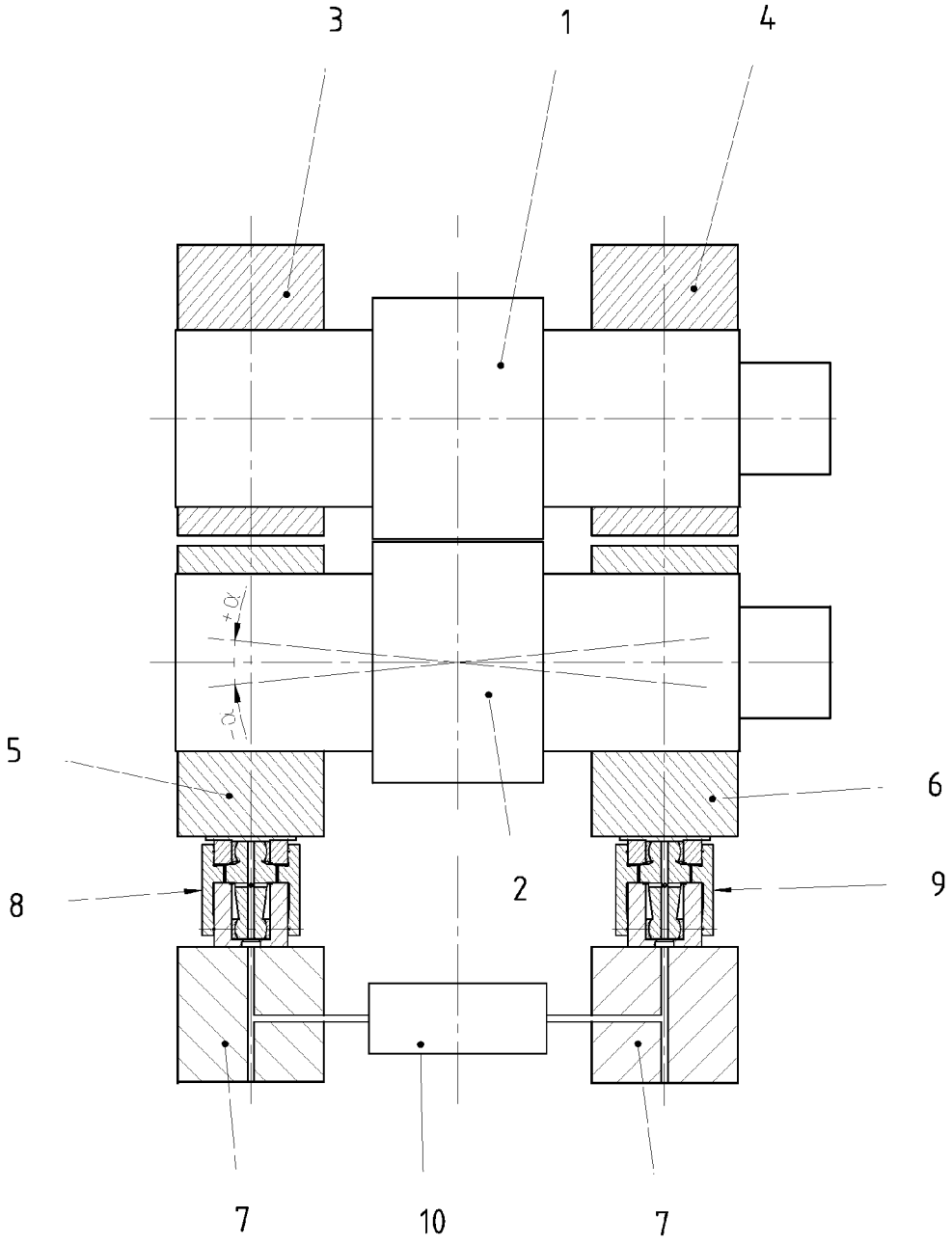
FIG. 1 is a schematic top view of a roller grinding mill in the form of a roller mill.

The roller grinding mill illustrated in FIG. 1 has two grinding rollers 1 and 2 which are pressed against each other at high pressure and of which the grinding roller 1 is supported as a fixed roller in fixed bearings 3, 4 and the grinding roller 2 is supported as a loose roller in movable bearings 5, 6.

The movable bearings 5, 6 of the grinding roller 2 are supported on a fixed counter-bearing 7 by means of dual-articulation actuating cylinders 8, 9 which are a constituent part of the pressing system for applying a force to the grinding stock via the grinding roller 2. In addition to the two actuating cylinders 8, 9, the pressing system has a hydropneumatic store 10 connected to the cylinders.

The actuating cylinders 8, 9 allow all movement of the grinding roller 2 occurring during operation of the roller grinding mill, in particular the oblique positions of the grinding roller 2 at an angle $\pm\alpha$, as indicated in FIG. 1.

The two actuating cylinders 8, 9 are of identical construction and are explained in greater detail below with reference to FIGS. 2 and 3.

They have a housing 11 which acts as a coupling rod and which is constructed so as to be rotationally symmetrical about an axis 11*e* and which provides for an outer cylindrical housing wall 11*a* and a partition wall 11*b* which divides the housing into two portions and which extends transversely relative to the housing wall. A first piston 12 is arranged in one portion and a second piston 13 is arranged in the other portion. The two pistons are constructed in a cup-like manner and are sealed by annular seals 16, 18 at a contact location on the housing wall 11*a*, respectively.

There is further provided in each portion on the partition wall 11*b* a central journal 11*c*, 11*d* which is constructed so as to be rotationally symmetrical relative to axis 11*e* and the ends of which form universal ball joint-like pivot joints 11*f*, 11*g* and support the two pistons internally in a rotationally movable manner, respectively. In order to prevent great deformations at the annular seals 16, 18, the universal ball joint-like pivot joints 11*f*, 11*g* are arranged in the plane of the seals.

There is provided between the first piston and the pivot joint 11*f* an intermediate element 14 which is connected to the piston 12 and which allows rotary movement of the piston about a pivot location 17 of the first pivot joint 11*f*. Accordingly, there is also provided between the second pivot joint 11*g* and the second piston 13 an intermediate element 15 which ensures rotation of the second piston 13 about a pivot location 26 of the second pivot joint 11*g*.

To that end, the journals 11*c* and 11*d* have at the ends thereof universal ball joint-like first contact faces 11.1*c* and 11.1*d* which co-operate with correspondingly complementary second contact faces 14.1 and 15.1 at the intermediate elements 14 and 15 and which allow rotation of the pistons 12, 13 about the pivot locations 17, 26. For that purpose, the housing wall 11*a* is constructed in the region of the contact locations with the two pistons 12, 13 so as to have slight inward curvature.

Each of the two pistons 12, 13 has its own pressure chamber 19, 20 which are, however, connected to each other via a line 21 which is constructed centrally in the journals 11*c*, 11*d*. The pressure chamber 20 of the second piston 13 is further supplied via branches 22, 23 which extend from the line 21. Furthermore, the two pressure chambers 19, 20 are directly connected to each other via connection lines 24, 25 in the partition wall 11*b*. The pressure chambers are further connected to the hydropneumatic store 10 via a hole 13*a* in the piston. During operation, the actuating cylinders 8, 9 are acted on with a desired pressure via the hydropneumatic store 10, the second piston 13 being supported on the counter-bearing 7 and the first piston 12 being supported on the movable bearings 5, 6.

Figure 2:
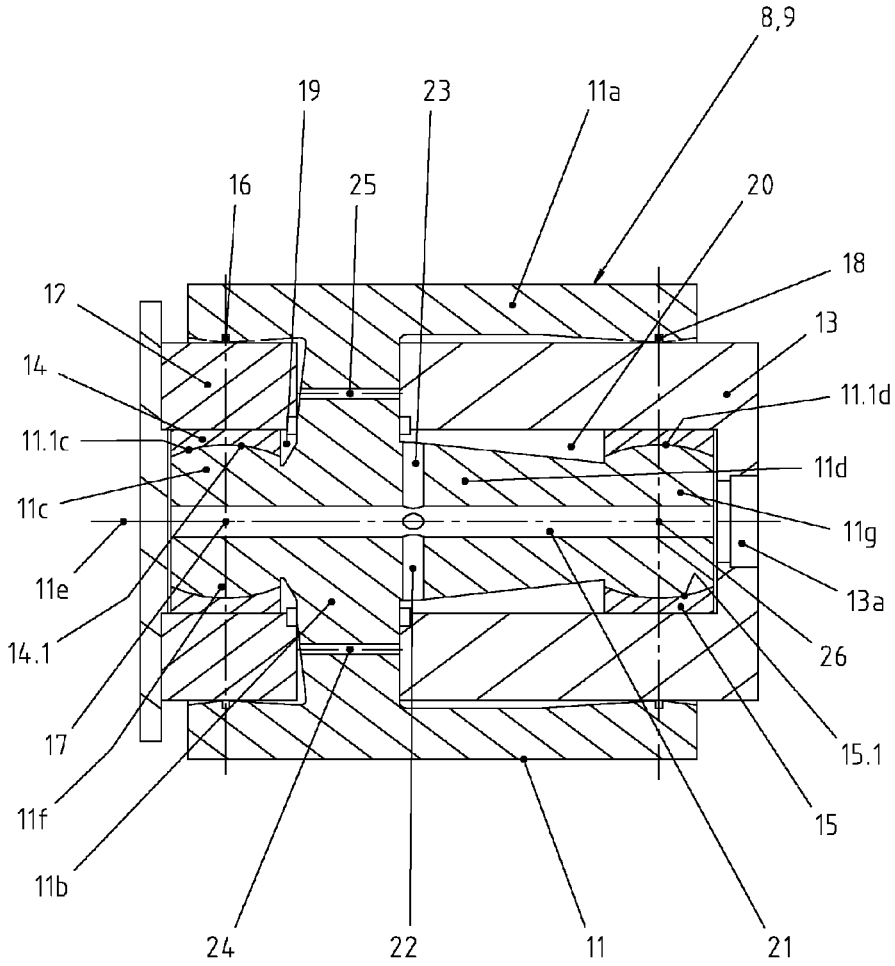
FIG. 2 is a sectional illustration of a dual-articulation actuating cylinder according to the invention in a first position and FIG. 3 is a sectional illustration of the dual-articulation actuating cylinder in a second position.
Figure 3:
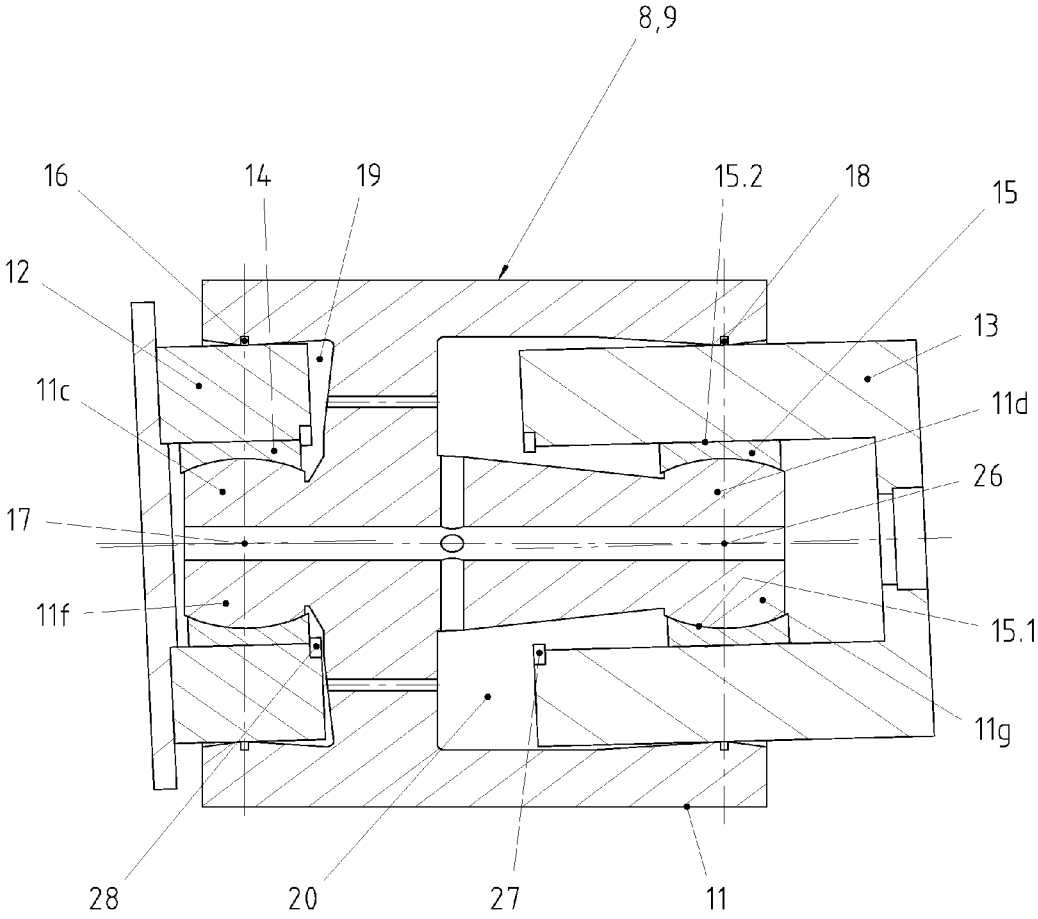

FIG. 3 shows the actuating cylinder 8, 9 according to FIG. 2 in an operating position, in which the two pistons 12, 13 take up an angular position relative to the housing 11 and the second piston 13 is partially withdrawn. It is evident that the intermediate element 15 not only has a second contact face 15.1 in order to allow rotary movement about the pivot location 26 but also has a third contact face 15.2 which co-operates with the piston 13 and which allows linear displacement between the second piston 13 and the intermediate element 15. The maximum displacement travel is limited by a stop ring 27 at the end of the piston 13 projecting into the pressure chamber 20. The first piston 12 and its intermediate element 14 are also constructed accordingly, the linear movement being limited by a stop ring 28. In the embodiment illustrated, however, the piston length is of such a size that the piston 12 cannot carry out linear displacement or can carry out only very small linear displacement.

Depending on the application, however, the first piston 12 and the housing 11 could also be constructed in such a manner that it is possible to carry out relatively large linear displacements. In particular, it is conceivable that both pistons are of identical construction.

The maximum coupling length is determined by the spacing between the two pivot locations 17 and 26 and the maximum travel of the two pistons. Since the pivot joints 11*g*, 11*f* are constructed at the ends of the journals 11*c*, 11*d* which are constructed inside the housing 11, the rotary movements are clearly carried out in the pivot joints of universal ball joint-like form so that pressure on the annular seals 16, 18 is reduced. The coupling length is further maximised by means of that construction with a predetermined structural length. The transverse force loading is further minimised by the constant spacing of the two pivot joints, which further reduces pressure on the seals.

Furthermore, another advantage is that the rotary movement between the first contact face on the housing and the second contact face on the intermediate element is distinctly and clearly separated from the linear displacement between the third contact face on the intermediate element and the piston. Smaller surface pressures are thereby produced and consequently less wear.

The invention claimed is:

1. Roller grinding mill for comminuting brittle grinding stock having a. at least one grinding roller which co-operates with a counter-face in such a manner that the grinding stock is comminuted between the grinding roller and the counter-face and b. a pressing system for applying a force to the grinding stock via the grinding roller, the pressing system having the following components:

b1. at least one hydropneumatic store and b2. at least one dual-articulation actuating cylinder which is connected to the hydropneumatic store and which has pistons and a housing, characterised in that the dual-articulation actuating cylinder has two pistons and a housing which acts as a coupling rod.

2. Roller grinding mill according to claim 1, characterised in that the dual-articulation actuating cylinder has two pivot joints which have fixed spacing relative to each other.

3. Roller grinding mill according to claim 2, characterised in that the two pivot joints are constructed as journals connected to the housing.

4. Roller grinding mill according to claim 3, characterised in that the journals have ends which are constructed in the manner of a universal ball joint.

5. Roller grinding mill according to claim 1, characterised in that the two pistons are supported in such a manner that the force which can be produced by the actuating cylinder can be transmitted to the at least one grinding roller with lateral and angular displacement.

6. Roller grinding mill according to claim 1, characterised in that both pistons are rotationally movable and at least one of the two pistons is supported for linear displacement.

7. Roller grinding mill according to claim 1, characterised in that the actuating cylinder provides for each piston a pivot joint) which has a first contact face on the housing and a second contact face on the pistons or an intermediate element arranged between the piston and the housing.

8. Roller grinding mill according to claim 7, characterised in that there is provided the intermediate element which has the second contact face at one side and, at an opposite face, a third contact face which allows linear displacement between the piston and the intermediate element.

9. Roller grinding mill according to claim 1, characterised in that the actuating cylinder is provided with pressure oil lubrication.

* * * * *